United States Patent [19]

Panovic

[11] Patent Number: 5,076,519

[45] Date of Patent: Dec. 31, 1991

[54] BRUSH HOLDER

[76] Inventor: Goran Panovic, 14070 - 57A Avenue, Surrey, British Comumbia, V3W 6X7, Canada

[21] Appl. No.: 509,025

[22] Filed: Apr. 10, 1990

[51] Int. Cl.[5] ..... B65D 25/00

[52] U.S. Cl. ..... 248/110

[58] Field of Search ..... 248/110, 112, 113, 111; 211/66, 65; 220/90; 206/362.4, 362, 361; D4/116, 118, 114

[56] References Cited

U.S. PATENT DOCUMENTS

| | | | |
|---|---|---|---|
| 2,469,864 | 5/1949 | Craft et al. | 248/110 |
| 2,808,960 | 10/1957 | Wilson | 248/110 X |
| 2,827,648 | 3/1958 | Geisz | 220/90 X |
| 3,156,364 | 11/1964 | Wolcott | 211/65 |
| 3,395,828 | 8/1968 | Schnabel | 220/90 |
| 3,407,429 | 10/1968 | Di Nardo | 248/110 X |
| 3,688,943 | 9/1972 | Brown | 220/90 |

FOREIGN PATENT DOCUMENTS

| | | | |
|---|---|---|---|
| 2188026 | 9/1987 | United Kingdom | 220/90 |

*Primary Examiner*—Ramon O. Ramirez
*Assistant Examiner*—Robert A. Olson
*Attorney, Agent, or Firm*—Fulwider, Patton, Lee & Utecht

[57] ABSTRACT

A paint brush holder to be attached to a paint can. The holder is an open topped container having an inner wall to conform to the outer surface of the paint can. The holder is suspended from the paint can. A brush scraper is attached to the open topped container to extend downwardly into the paint can. Projections on the brush scraper allow the removal of pain from a brush moved across the projections. The scraper may be removably attached to the open topped container or may be formed integrally with that container.

2 Claims, 2 Drawing Sheets

10
22
30
28
12
3
32
36
3
2
2
24
20
40
36
14
18
22
30
28
16

42
22
28
12
10
34
18
14
32
26
16
30
20
24

BRUSH HOLDER

This invention relates to a paint brush holder to be attached to a paint can.

When a painter has temporarily finished using a brush the painter typically lays the brush across the top of the paint can. The bristles extend beyond the wall of the paint can and this can result in drips and mess. It is also a relatively unstable position and the brush can fall from the can, making a further mess. Furthermore, there are frequently residues of paint around the top of the paint can so that the paint can get onto the handle and, subsequently, onto the hands of the painter.

The present invention seeks to avoid this problem by providing a paint brush holder to be attached to a paint can, the holder comprising:

an open topped container having having an inner wall to conform to the outer surface of the paint can;

means to suspend the holder from the paint can;

a brush scraper attached to the open topped container to extend downwardly into the paint can; and projections on the brush scraper to allow the removal of paint from a brush moved across the projections.

The paint brush holder finds particular application in what may be regarded as a universally conventional paint can, that is one with inner and outer upstanding walls at the top of the paint can and with a channel formed between the upstanding walls to receive a lid with a press, air-tight fit.

The means to suspend the holder from the paint can top may comprise hooks to fit over the top edge of the paint can or clips, formed integrally with the upper edge of the open topped container, to clip onto the outer wall of the paint can top.

The scraper can be removably attached to the open topped contained or can be formed integrally with the open topped container. When the brush scraper is removably attached to the open topped container the scraper preferably has clips to clip onto the top of the open topped container and the inner wall of the paint can top. This provides a secure mounting for the brush scraper but is also a simple means of ensuring the desired downward inclination of the scraper so that paint scraped off the brush runs downwardly, back into the paint can.

The invention is illustrated in the drawings in which.

Figure 1:
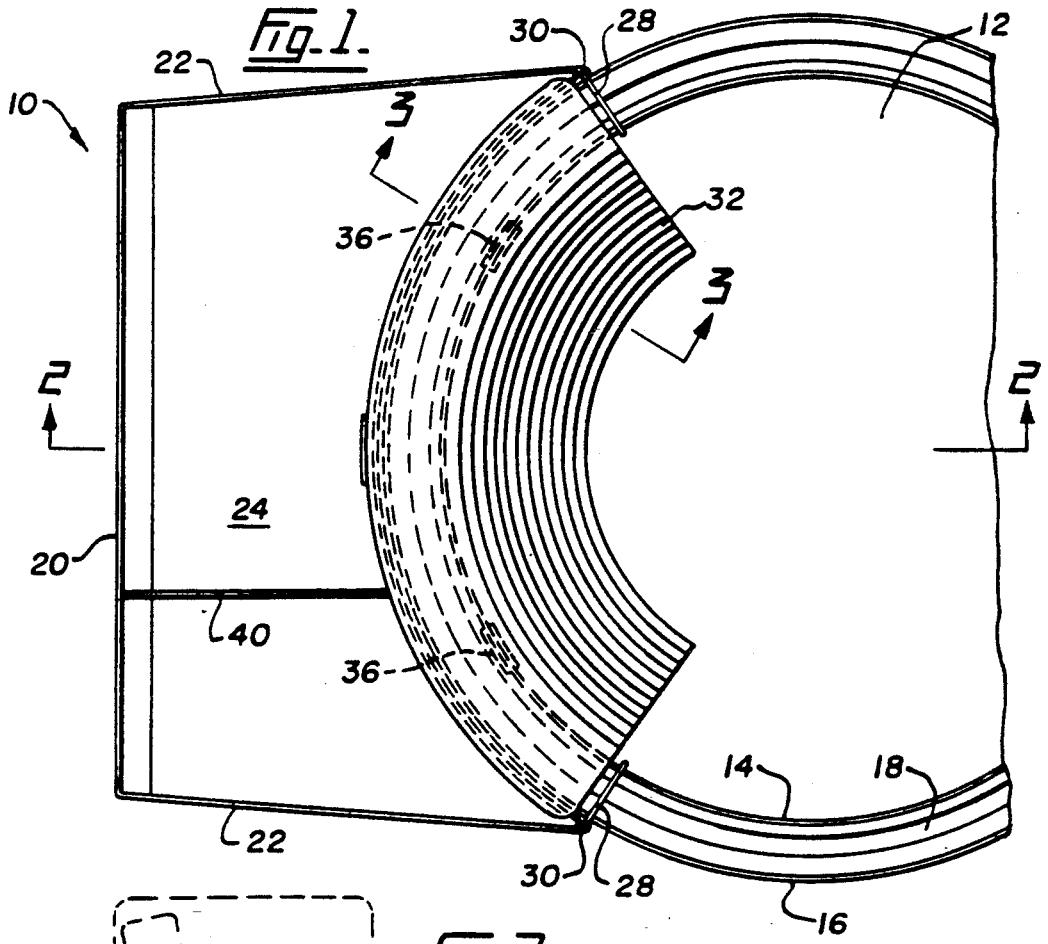
FIG. 1 is a partial plan view of the holder according to the present invention in place on a paint can.

The drawings show a paint brush holder 10 to be attached to a paint can 12. The paint can 12 is shown as a conventional paint can in which the top has inner and outer upstanding walls 14 and 16 with a channel 18 between the upstanding walls to receive a lid with an airtight fit. The arrangement is most clearly shown in FIGS. 3 and 4.

The holder 10 comprises an open topped container having an outer wall 20, side walls 22, a flat base 24 and an inner wall 26 shaped to conform to the outer surface of the paint can 12 which, of course, is usually arcuate.

Figure 2:
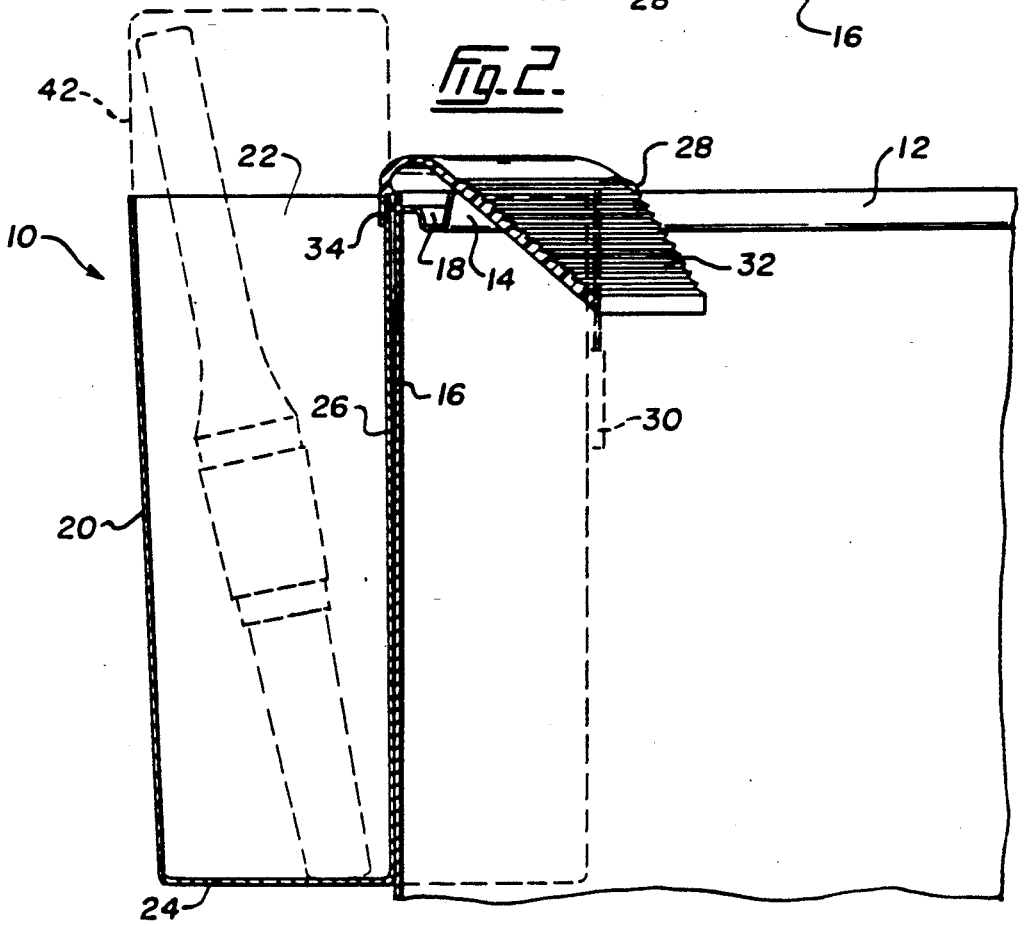
FIG. 2 is a section on the line 2—2 in FIG. 1.

The holder 10 has means to suspend it from the paint can. FIGS. 1 and 2 show the means comprising hooks 28 attached to housings 30 formed on the exterior of the holder 10.

Figure 3:
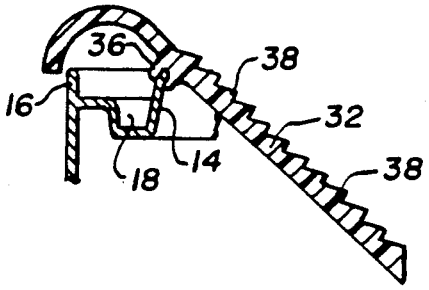
FIG. 3 is a section on the line 3—3 in FIG. 1.

In FIGS. 1 to 3 the holder includes a brush scraper 32 that is adapted to be attached to the holder 10 by the provision of a clip 34 (see FIG. 2) to clip onto the top of the wall 26 and a further clip 36 to clip over the inner wall 14 of the paint can top. The arrangement concerning the inner clip is most clearly shown in FIG. 3. FIG. 3, together with FIG. 2, also shows clearly the inclination of the brush scraper downwardly. There are projections 38 on the brush scraper 32 to allow the removal of paint from a brush moved across the projections 38.

As shown in FIG. 1 there is a wall 40 to divide the holder 10 into a plurality of compartments. Lid 42 may be provided for holder 10—see FIG. 2.

To use the paint brush holder of FIGS. 1 to 3, the holder 10 is suspended over the opened top of paint can 12. The brush scraper 32 is clipped into position by engaging clips 36 over the inner wall 14 of the can 12 and by engaging the clip 34 on the inner wall 26 of the holder 10, as shown in FIGS. 2 and 3.

The paint can is then used in conventional fashion. The paint brush holder of the invention is lightweight. When it is desired to remove excess paint from the brush, it is simply scraped on the brush scraper 32 and any paint thus removed passes from the brush and drips downwardly into the can 12. In intervals between painting, the brush may be positioned as shown in FIG. 2, that is substantially vertical with the bristles downwardly. There is no prospect of the brush falling.

The holder 10 may be made of lightweight plastic material. Alternatively, it may be made of wire with a lightweight, flexible, disposable inner envelope that fits within the wire container.

Figure 4:
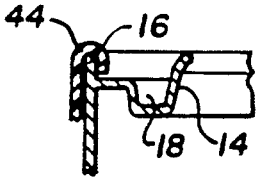
FIG. 4 shows a detail of the invention.

FIG. 4 shows a variation of the embodiment of FIGS. 1 to 3 in which the upper edge of the inner wall 26 is formed with a clip 44, in place of the hooks 28, to clip on the outer wall 16 of the paint can 12.

Figure 5:
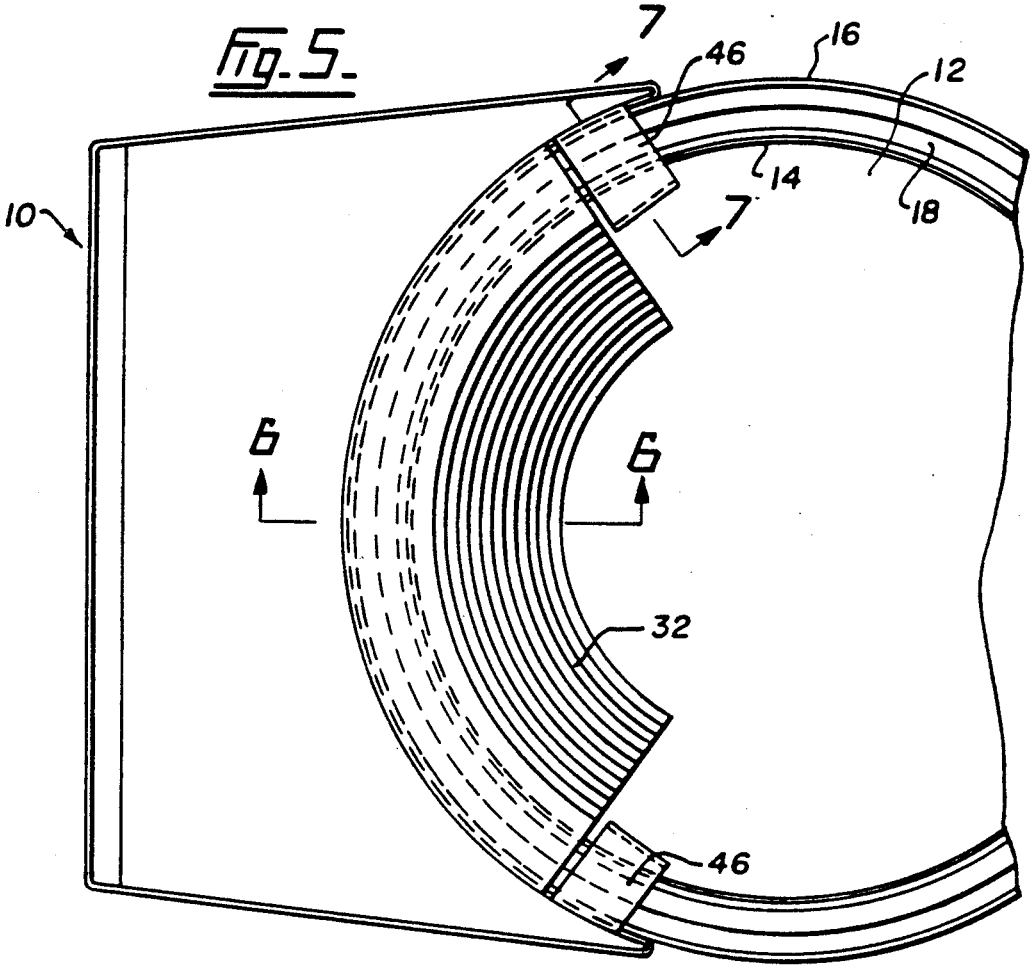
FIG. 5 is a partial plan view of a further embodiment of the invention.
Figure 6:
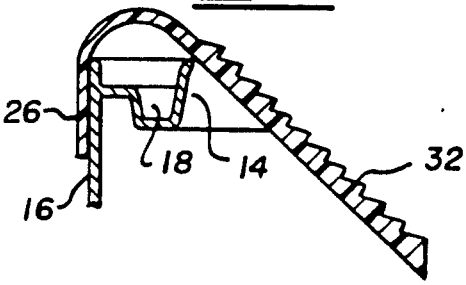
FIG. 6 is a section on the line 6—6 in FIG. 5.
Figure 7:
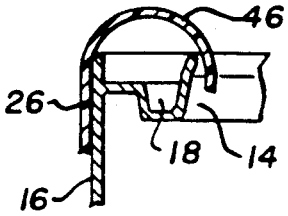
FIG. 7 is a section on the line 7—7 in FIG. 5.

FIG. 5 to 7 show an embodiment of the invention in which the scraper 32 is formed integrally with the holder 10. Typically the scraper 32 and the holder 10 will be molded in a single piece. There are clips 46 at each end of the holder 10 that act to suspend the paint brush holder, that is the holder 10 and the scraper 32, over the wall of a paint can 12.

In use the embodiment of FIGS. 5 to 7 is precisely the same as that of the previously described embodiments.

An advantage of the illustrated apparatus is that the holder 10 can also be used as a simple means of washing brushes after use.

As in the previous embodiments, holder 10 in FIG. 5 may be provided with a press fit lid 42, as shown in FIG. 2.

I claim:

1. A paint brush holder to be attached to a paint can, the paint can having a top and an arcuate outer surface and inner and outer upstanding walls at the paint can top, the holder comprising:

an open topped container to occupy a part only of the periphery of the paint can top, the open topped container having a lid and an inner wall to conform to the outer surface of the paint can, a flat base to be free standing when the paint brush holder is not attached to the paint can and, side walls;

a pair of clips, one adjacent each side wall of the open topped container to attach to the paint can top to suspend the holder from the paint can;

a brush scraper formed integrally with the open topped container, the brush scraper extending upwardly from the inner wall of the container then downwardly to contact, and to be supported by, the inner upstanding wall of the paint can and to extend downwardly into the paint can; and projections on the brush scraper to allow the removal of paint from a brush moved across the projections.

2. A holder as claimed in claim 1 in which the open topped container includes at least one divider wall to divide the container into a plurality of compartments.

* * * * *